US010301878B2

(12) United States Patent
Degen et al.

(10) Patent No.: US 10,301,878 B2
(45) Date of Patent: May 28, 2019

(54) VIBRATOR ARRANGEMENT COMPRISING A CABLE SUSPENSION PENETRATING INTO THE GROUND AND METHOD FOR SAME

(76) Inventors: Alexander Degen, München (DE); Wilhelm Degen, Irvine, CA (US)

( * ) Notice: Subject to any disclaimer, the term of this patent is extended or adjusted under 35 U.S.C. 154(b) by 96 days.

(21) Appl. No.: 13/261,757

(22) PCT Filed: Apr. 13, 2012

(86) PCT No.: PCT/DE2012/200025

§ 371 (c)(1),
(2), (4) Date: Jan. 21, 2014

(87) PCT Pub. No.: WO2013/041096

PCT Pub. Date: Mar. 28, 2013

(65) Prior Publication Data

US 2014/0158435 A1 Jun. 12, 2014

(30) Foreign Application Priority Data

Apr. 14, 2011 (DE) ..... 10 2011 007 398

(51) Int. Cl.
*E21B 7/24* (2006.01)
*E02D 3/054* (2006.01)

(52) U.S. Cl.
CPC ..... *E21B 7/24* (2013.01); *E02D 3/054* (2013.01)

(58) Field of Classification Search
USPC ..... 405/232
See application file for complete search history.

(56) References Cited

U.S. PATENT DOCUMENTS

| | | | | |
|---|---|---|---|---|
| 3,289,774 | A * | 12/1966 | Bodine, Jr. | 175/19 |
| 3,309,877 | A | 3/1967 | Degen | |
| 4,280,772 | A * | 7/1981 | Rusche | 405/232 |

FOREIGN PATENT DOCUMENTS

| | | | |
|---|---|---|---|
| DE | 578 650 | | 6/1933 |
| FR | 2717492 | A5 * | 9/1973 |
| GB | 395 323 | | 7/1933 |
| GB | 1 039 645 | | 8/1966 |

* cited by examiner

*Primary Examiner* — Kyle Armstrong
(74) *Attorney, Agent, or Firm* — Muirhead and Saturelli, LLC

(57) ABSTRACT

A device is provided for vibration compression or for producing cavities and/or material columns in the ground. The device comprises a vibrator with a pipe which has an upper end and a lower end and also two cable suspensions which are arranged on the pipe at a distance from the upper end. A cable is secured to each cable holder. A support device for the vibrator arrangement comprises a guide device on which the cables are guided in the longitudinal direction of the pipe between the cable holders and the upper end or above the upper end.

21 Claims, 4 Drawing Sheets

B - B

VIBRATOR ARRANGEMENT COMPRISING A CABLE SUSPENSION PENETRATING INTO THE GROUND AND METHOD FOR SAME

TECHNICAL FIELD

This application relates to a vibrator arrangement, more particularly a vibrator arrangement with a depth vibrator.

BACKGROUND OF THE INVENTION

In order to improve the ground it is fundamentally known to make material columns, such as for example gravel columns, in the ground. The production of such columns is carried out by way of example by using a vibrator arrangement with a spud vibrator which is mounted at the lower end of a pipe. The pipe can be a silo pipe for receiving material when the vibrator arrangement is formed as a so-called sluice vibrator for producing vibrating packing columns, or the pipe can be an extension pipe when the vibrator arrangement is formed as a "simple spud vibrator" for use with vibrating compression. For producing a column (vibrating packing column) the vibrator arrangement is hereby introduced with the silo pipe down to a desired depth into the ground whereby a column-like cavity is created which is initially filled up by the vibrator with the silo pipe. This cavity is then filled with the loose bulk material, such as for example with gravel. For this the vibrator arrangement is moved up and down step by step with the silo pipe. As the vibrator is moved upwards a cavity is formed underneath that of the vibrator arrangement which is filled up with the filler material from the silo pipe—which has an opening at its lower end. The material thus ejected is then compacted as the vibrator is moved down again. This process is repeated until a material column of the desired height is created.

When proceeding with vibration compression the particled ground is compacted by vibration without a column of foreign material being created. For this the spud vibrator is first lowered to the full compaction depth and then is lifted step by step, such as by way of example in steps of for example 0.5 to 1 m. After each lift the spud vibrator is stopped for a time in order to compact the surrounding ground before being raised further. The spud vibrator is brought in this way in stages up to the surface.

FIG. 1 shows a device with a vibrator arrangement 1 according to the prior art. The vibrator arrangement 1 with this device is held on a cable 6 which is guided over a roller head 3 which is fastened at an upper end of the vibrator arrangement 1. The cable 6 runs furthermore over a mast head roller 2 at the upper end of an excavator mast 8 of an excavator 4 and along the excavator mast 8 down to an excavator winch (not shown here). The useful length of the vibrator arrangement 1 which can penetrate into the ground amounts to z. This useful length determines the depth of the material column which can be produced in the ground by means of the vibrator arrangement 1.

With the known device a distance has to be kept from the mast roller 2, and shown in FIG. 1 by x. Furthermore, the roller head 3 which has a length y cannot penetrate into the ground. Thus of a total height t (=x+y+z) of the excavator 4 only a clearly smaller part, namely the part defined by the length z of the vibrator arrangement, can be used.

U.S. Pat. No. 3,309,877 describes a device with a vibrator arrangement which is held on a boom of an excavator. Two cables are guided over guide pulleys on the excavator up to the fastening points in the region of an upper end of the vibrator arrangement. During operation of the device a force can be applied to the vibrator by winding up the two cables whereby the vibrator can be inserted into the ground.

Further devices with vibrator arrangements are described in GB-L039645 or DE-A-578650.

Accordingly, it would be desirable to provide a device with a vibrator arrangement which has an overall height and with which a penetration depth of the vibrator arrangement into the ground corresponds to a greater part of the overall height than in the case of known devices of this kind.

SUMMARY OF THE INVENTION

According to an embodiment of the system described herein, a device is provided for vibration compression or for producing cavities and/or material columns in the ground. The device comprises a vibrator arrangement with a pipe which has an upper end and a lower end and which has two cable holders which are arranged spaced from the upper end on the pipe, as well as each with a cable fastened on each cable holder. The device furthermore comprises a support device for the vibrator arrangement wherein the support device has a guide device on which the cables are guided and which is arranged in a longitudinal direction of the pipe between the cable holders and the upper end or above the upper end.

The guide device has an upper end and can in particular be designed so that the upper end of the pipe can be guided in the guide device at least up to the upper end of the guide device.

The guide device which alone supports the vibrator arrangement comprises by way of example two deflection devices wherein in each case one cable is guided on one deflection device, two cable winches wherein in each case one cable is guided held on a cable winch, or one cable winch, which is arranged spaced from the pipe wherein the cables are held on opposite ends of the cable winches.

BRIEF DESCRIPTION OF THE DRAWINGS

Embodiments of the system described herein will now be explained below with reference to the drawings. The figures serve to explain the basic principle so that only those features are shown which are necessary for understanding the basic principle. The figures are not necessarily true to scale. Unless indicated differently, the same reference numerals show in the drawings the same features with the same meaning.

DETAILED DESCRIPTION OF VARIOUS EMBODIMENTS

The system described herein can be applied both to vibrator arrangements which are formed as sluice vibrators for producing vibrator packing columns and which have a silo pipe for receiving the material, and also to vibrators with an extension pipe. In both cases a vibrator unit can be arranged on a lower end of the pipe wherein in the last mentioned case the pipe does not serve for supplying material. The term "pipe" designates in the following either a silo pipe or an extension pipe.

Figure 2:
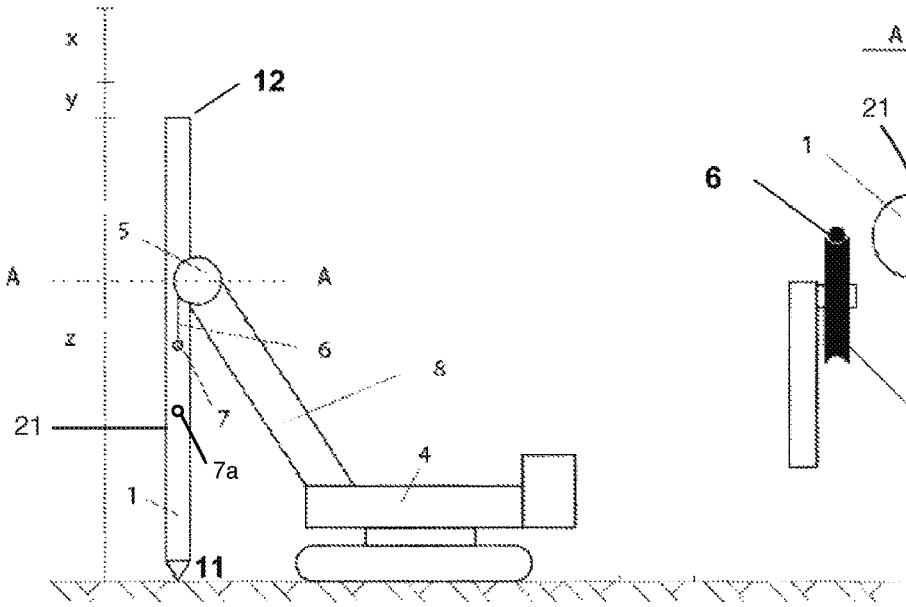
FIG. 2 shows a first embodiment of a device with a vibrator arrangement and a support device.

FIG. 2 shows a first embodiment of a device with a vibrator arrangement 1 and a support device 4 for holding the vibrator arrangement 1. The vibrator arrangement 1 comprises a pipe 21 with a vibrator tip 11 which is designed to penetrate into the ground, and a vibrator (not shown) arranged inside the pipe 21. The vibrator is designed to set the pipe 21 more particularly the vibrator tip 11, in vibrations so that the vibrator arrangement 1 can penetrate into the ground solely as a result of its inherent weight, i.e. without any additional external force acting on the pipe 21. Insofar as the pipe 21 is designed as a silo pipe the material can be supplied into the pipe 21 in any way. The pipe 21 has in the region of the vibrator tip 11 an outlet via which the material can be introduced into the ground from the pipe 21. Basically the pipe 21 of the vibrator arrangement 1 and the interior of the pipe 21 are designed as with a conventional vibrator arrangement.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

Figure 1:
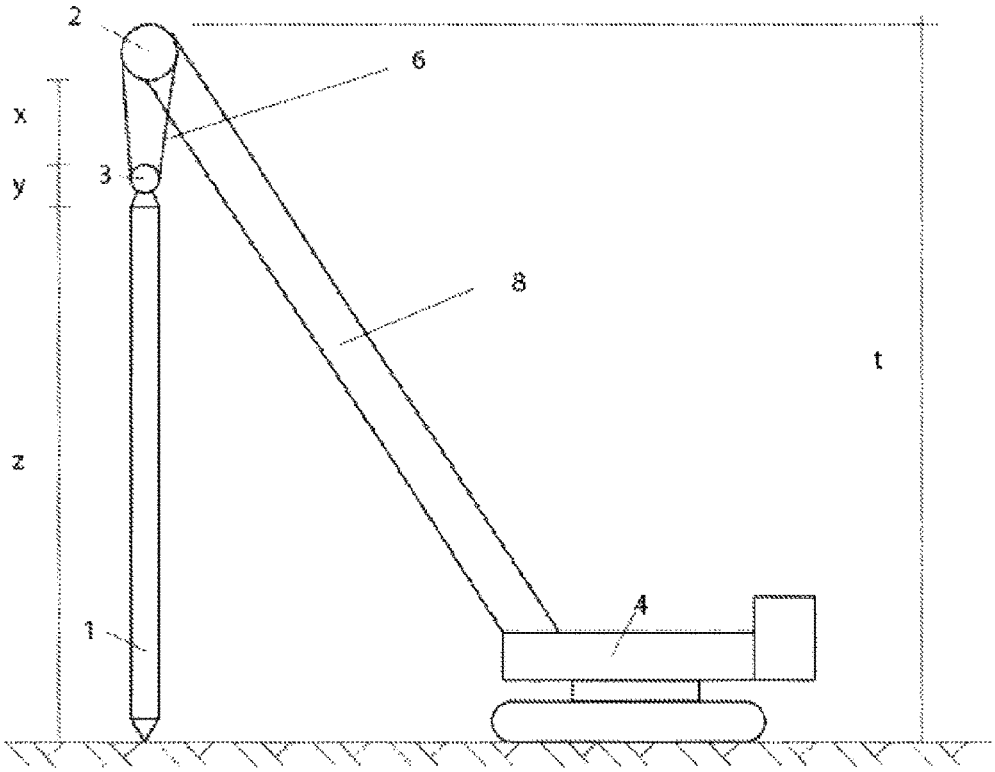
FIG 1 (Prior Art)
FIG. 1 shows a device with a vibrator arrangement and an excavator according to the prior art.

This support device 4 is designed in the illustrated example (as with the known device according to FIG. 1) as an excavator with excavator arm 8 on which the vibrator arrangement 1 is held at the upper end thereof. Differently from the known device, the overall height of the arrangement according to the figure—then when the vibrator arrangement 1 is set up and the vibrator tip 11 stands on the ground—is only determined by the length z of the vibrator arrangement 1. Compared to the known device in which the dimensions x, y which are likewise shown in FIG. 2, of further components are added to the length z of the vibrator arrangement 1, a considerable saving in overall height is achieved. This can be decisive as to whether this method can be applied, particularly with construction works close to airports or when building under bridges or heavy-duty power lines.

Shortening the overall height compared to the known devices can be achieved according to some embodiments if the vibrator arrangement 1 is held by two supporting cables 6 which are each fastened on the pipe 21 spaced from an upper end 12 thereof, and the support device 4 during operation of the arrangement is mounted between two fastening points of the cables and the upper end 12 of the pipe 21 or even above the upper end 12 of the pipe 21. More particularly the upper end 12 of the vibrator arrangement 1 can be moved up to an upper end of the support device 4 or beyond. The two cables 6 are more particularly fastened on the pipe 21 at points which are opposite one another. The upper end 12 of the pipe 21 is an end of the pipe 21 opposite the vibrator tip 11. The upper end of the support device 4 is, in the example according to FIG. 2, determined by a guide device for the cables 6 or by an upper end of the guide device. The support cables can be wound up or down by a conventional cable winch (not shown) wherein the winding up or down of the two support cables more particularly takes place synchronously. The guide device supports the vibrator arrangement 1 alone by cables so that no further holding device or no further cables are required.

Figure 3:
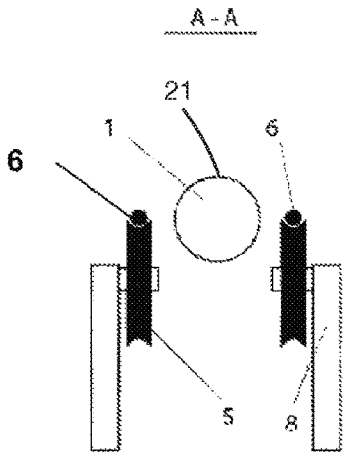
FIG. 3 shows in detail a holder for the vibrator arrangement on the support device.

An embodiment of the guide device is illustrated in FIG. 3. This guide device has two deflection devices or rollers 5 which with the support device 4 according to FIG. 2 are arranged at the upper end (at the top) of a mast or support arm 8 and which therefore can also be called mast head rollers. The mast rollers 5 are arranged spaced apart relative to one another so that the pipe 21 of the vibrator arrangement 1 is located between the rollers so that when winding up the cable 6 the upper end 12 of the pipe 21 can be guided between the two rollers 5 and through up to the upper end of the support device 4 or guide device formed by the rollers 5 or even beyond the upper end of the support device 4 (guide device) (as shown in FIG. 2). The two rollers 5 and the parts of the support arm 8 on which the rollers are held form a type of fork within which the pipe 21 of the vibrator arrangement 1 can be guided. This fork can also be called a forked head.

Referring to FIG. 2, the cables (support cables) 6 are fastened directly on the pipe 21 such as by way of example by means of suspension rings 7. The fastening points of the cables 6 on the pipe 21 lie by way of example above a center of gravity of the vibrator arrangement 1, i.e. between the center of gravity and the upper end 12. The fastening points can moreover also lie underneath the center of gravity, i.e. between the center of gravity and the vibrator tip 11.

The vibrator arrangement 1 can be driven with its entire length into the ground, i.e. up to the upper end 12. The cables 6 thereby also penetrate into the ground. A possible soiling of the cables is thereby acceptable. When used on a raft it may be that the cables even come into contact only with water.

The suspension rings or ring holders 7, **7*a* which hold the cables 6 can be arranged at the same longitudinal position of the pipe 21 of the vibrator arrangement 1, but spaced relative to one another in the peripheral direction. The ring holders 7, 7*a* can however also be arranged at different longitudinal positions of the pipe 21, such as by way of example one above 7 and one below 7*a* the center of gravity of the vibrator arrangement 1. When dismantling the vibrator arrangement 1 for transport, the upper cable 6, i.e. the cable 6 fastened above the center of gravity, can then be slowly unwound whereupon the vibrator arrangement 1** turns slowly from the vertical into the horizontal so that it can be taken up by a transport vehicle.

Instead of the support device 4 illustrated in FIG. 2 as a cable excavator, an apparatus which has a vertical mast (type of drilling apparatus, not shown here) can also be used as a support device.

Figure 4:
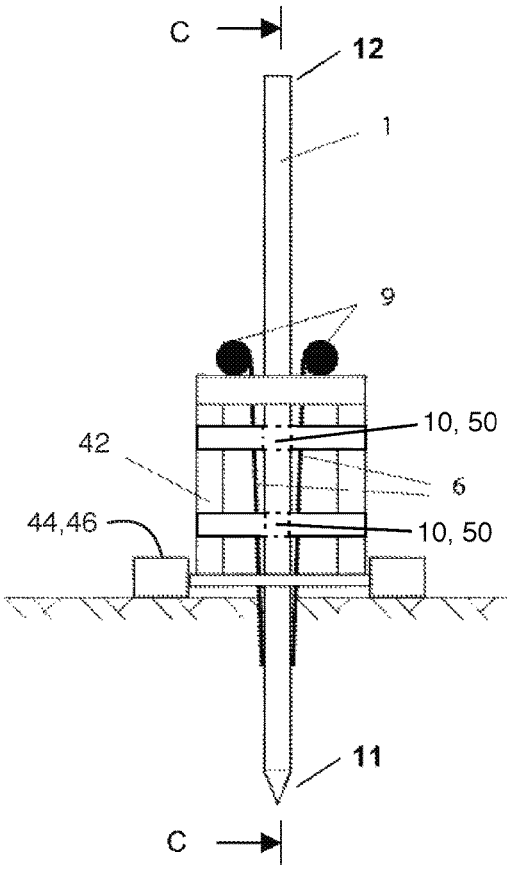
FIG. 4 shows a second embodiment of a device with a vibrator arrangement and a support device with certain features being omitted for clarity.
Figure 5:
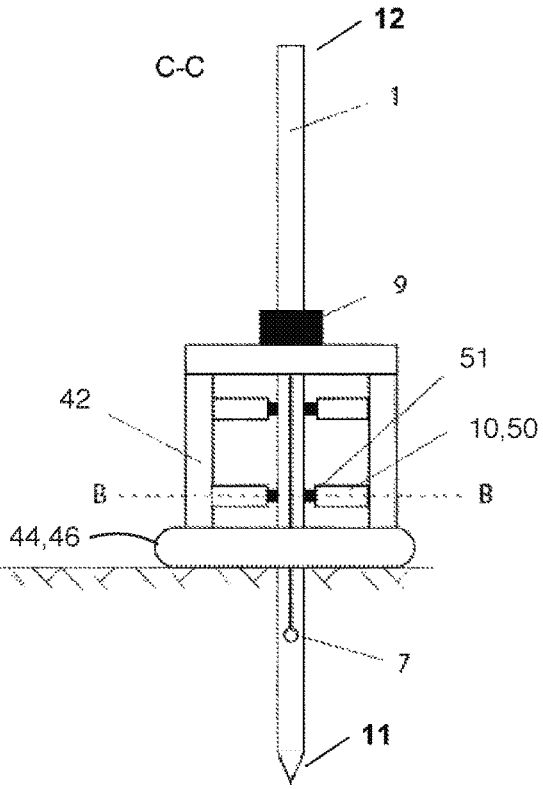
FIG. 5 shows the device according to FIG. 4 in another view, including features omitted from FIG. 4.

FIGS. 4 and 5 show a further embodiment of a device with a vibrator arrangement 1 and a support device 42. This support device 42 stands during use on the ground and comprises a framework structure inside which the vibrator arrangement 1 is guided. This framework structure can have a substantially box-shaped or cylindrical shape and is designed so that the vibrator tip 11 can be moved beyond a lower end of the support device 42. The height of the framework structure can be lower than the length of the vibrator arrangement 1 so that the upper end 12 of the vibrator arrangement 1 in the rest state, thus when the vibrator tip 11 stands up on the ground (differently from that shown), projects up beyond the support device 42. As a result of its centered weight distribution the support device 42 according to FIGS. 4 and 5 is particularly stable and can therefore have a lower weight compared with the excavator 4 according to FIG. 2, which makes it particularly economic. This apparatus, instead of as shown here standing on land on a caterpillar track mechanism 44 can also be used on water as a floating body 46 or floating crane.

A guide device for the two cables 6 is with this support device 42 likewise arranged at an upper end of the support device 42. This guide device corresponding to the example according to FIG. 3 can comprise rollers which are spaced so that the pipe 21 of the vibrator arrangement 1 can be guided between same and from which the cables are guided to a winch. With the example illustrated in FIG. 4, the cable winches (cable rollers) 9, on which the cables can be wound up, form the guide device. These winches 9 are fastened spaced from one another on the support device 42 so that the pipe 21 of the vibrator arrangement 1 can be guided in-between.

Optionally the support device 42 has guides 50, 51 for the vibrator arrangement 1 which are arranged spaced from the winches 9, and thus spaced from an upper end of the support device 42. FIG. 5 shows a side view of these guides 50, 51. With the illustrated example two guides 50, 51 are provided on which in each case two are spaced in a longitudinal direction of the pipe 21 of the vibrator arrangement 1. Each guide engages on opposing sides of the pipe 21. This variation enables the stop or the fastening of the cables 6 on the pipe also (far) below the center of gravity of the vibrator arrangement 1 since the pipe 21 is guided at the sides in at least two layers or at at least two positions spaced in the longitudinal direction of the pipe 21.

Figure 6:
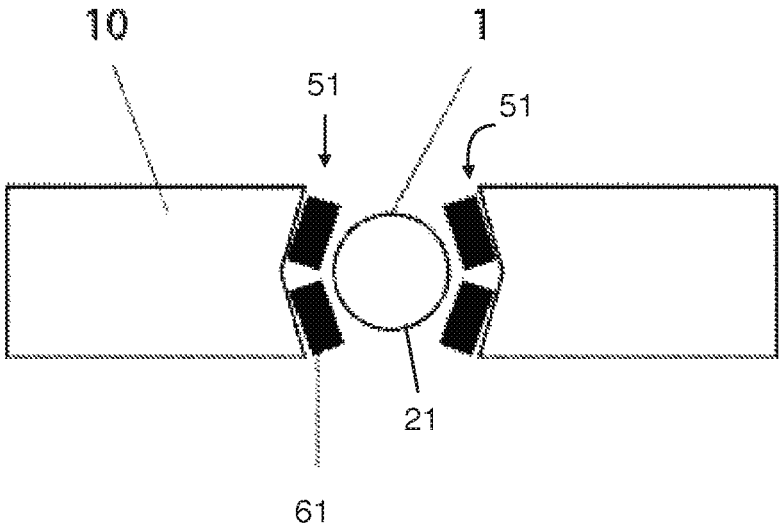
FIG. 6 shows a detail of the device according to FIG. 5.

FIG. 6 shows a cross-section through a guide 50, 51 of this type. This guide 50, 51 has guide elements 51, such as by way of example rollers 61 or other guide elements 51, such as for example a nylon rail, which are arranged in the peripheral direction around the silo pipe 21 of the vibrator arrangement 1 and which are fastened on spacers 10. The spacers 10 are in turn fastened on the frame of the support device 42. The spacers 10 with the guide element 51 support the pipe 21 relative to the remaining support device 42. Insofar as rollers 61 are provided as guide elements 51, these rollers 61 are mounted rotatably on the spacers 10. In the illustrated example according to FIG. 6 each guide has four rollers 61. This is however only one example. More than four rollers 61 (guide elements 51) can also be provided wherein at least three rollers 61 (guide element 51) should be provided per guide. The at least two guides 50, 51 each having at least three rollers 61 (guide elements 51) guide the pipe 21 above the ground and prevent the pipe 21 from tipping over wherein the rollers 61 (guide elements 51) bear against the pipe 21 and enable the pipe 21 to be raised and lowered.

Raising and lowering the vibrator arrangement 1 with the spud vibrator is carried out by means of the two cables 6 which are arranged opposite one another on the silo pipe 21 of the vibrator arrangement 1. Movement of the cables 6 is controlled by the two winches 9 which run parallel synchronised with one another. These two winches 9 are, in the example according to FIGS. 4 and 5, arranged spaced from one another on opposite sides of the pipe 21.

With a further embodiment only one cable winch 9 is provided for guiding the two cables 6, this winch being arranged spaced from the pipe 21 and with its length (length of the winding body) corresponding at least to the diameter of the pipe 21 wherein the one cable 6 is fastened at one end of the cable winch and the other cable is fastened at the other end of the cable winch. The two cables 6 can thereby each be wound up onto and unwound from the opposite side of the cable winch.

With the variation according to FIGS. 4 to 6 the useful length of the vibrator arrangement 1 can be increased even further compared with the apparatus height which is set by the height of the support device 42.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

The invention claimed is:

1. A device, comprising:

a vibrator arrangement including a pipe which has an upper end and a lower end and which has two cable holders which are arranged on the pipe spaced from the upper end thereof, a first cable being fastened on one of the cable holders and a second cable being fastened on an other one of the cable holders, wherein the cable holders are configured, together with the pipe, to penetrate into the ground; and a support device for the vibrator arrangement and the first and second cables, wherein the support device includes a guide device on which the first and second cables are guided and which, in a longitudinal direction of the pipe, is arranged between the cable holders and the upper end or above the upper end and wherein the first and second cables are used to raise the vibrator arrangement and wherein the vibration arrangement is lowered solely as a result of inherent weight thereof without any additional external force acting thereon, wherein the guide device includes two rollers spaced from one another so that the pipe is guidable between the rollers, and wherein the first cable is guided on one of the rollers and the second cable is guided on an other one of the rollers, the two rollers being arranged above a center of gravity of the vibrator arrangement prior to the pipe being lowered into the ground such that the two rollers solely support the pipe prior to being lowered into the ground.

2. The device as claimed in claim 1, wherein the guide device has an upper end and is designed so that the upper end of the pipe is guidable in the guide device at least up to the upper end of the guide device.

3. The device as claimed in claim 1, wherein the guide device is designed so that the upper end of the pipe can be guided beyond the upper end of the guide device.

4. The device as claimed in claim 1, wherein the guide device includes two cable winches which are arranged spaced apart so that the pipe is guidable between the cable winches, and wherein the first cable is guided on one of the cable winches and the second cable is guided on an other one of the cable winches.

5. The device as claimed in claim 1, wherein the guide device includes a cable winch having a first end and having a second end opposite the first end which is arranged spaced from the pipe wherein the first and second cables are held on the first and second ends of the cable winch.

6. The device as claimed in claim 1, wherein the cable holders are arranged spaced from one another in a peripheral direction of the pipe.

7. The device as claimed in claim 6, wherein the cable holders are arranged opposite one another on the pipe.

8. The device as claimed in claim 1, wherein the cable holders are arranged at a common longitudinal position in a longitudinal direction of the pipe.

9. The device as claimed in claim 1, wherein the cable holders are arranged between a center of gravity of the vibrator arrangement and the upper end of the pipe.

10. The device as claimed in claim 1, wherein the support device further includes at least two guide members which are arranged spaced from one another in a longitudinal direction of the pipe and which are designed to guide the pipe.

11. The device as claimed in claim 10, wherein each of the guide members has at least three guide elements which are arranged spaced from one another in the peripheral direction of the pipe and which engage on the pipe.

12. The device as claimed in claim 11, wherein the guide elements are rollers or rails.

13. The device as claimed in claim 1, wherein the support device includes a float body.

14. The device as claimed in claim 1, wherein the support device includes an earth moving apparatus with an extension arm on which the at least one cable roller is fastened.

15. The device as claimed in claim 1, further comprising a vibrator arrangement arranged on the lower end of the pipe.

16. The device as claimed in claim 1, wherein the guide device is arranged between the cable holders and the upper end while the first cable is fastened to the one of the cable holders and while the second cable is fastened to one of the other one of the cable holders, wherein the cable holders are configured, together with the pipe, to penetrate into the ground while the first cable is fastened to the one of the cable holders and while the second cable is fastened to one of the other one of the cable holders, and wherein the first and second cables are the only cables used to raise the vibrator arrangement.

17. A device, comprising:

a vibrator arrangement including a pipe which has an upper end and a lower end and which has two cable holders which are arranged on the pipe spaced from the upper end thereof, a first cable being fastened on one of the cable holders and a second cable being fastened on an other one of the cable holders, wherein the cable holders are configured, together with the pipe, to penetrate into the ground;

a support device for the vibrator arrangement and the first and second cables, wherein the support device includes a guide device on which the first and second cables are guided and which, in a longitudinal direction of the pipe, is arranged between the cable holders and the upper end or above the upper end and wherein the first and second cables are used to raise the vibrator arrangement and wherein the vibration arrangement is lowered solely as a result of inherent weight thereof without any additional external force acting thereon, wherein the cable holders are arranged spaced from one another in a longitudinal direction of the pipe.

18. A method of providing at least one of: vibration compression, cavities in the ground, and/or material columns in the ground, the method comprising:

providing a vibrator arrangement including a pipe which has an upper end and a lower end and which has two cable holders which are arranged on the pipe spaced from the upper end thereof;

fastening a first cable on one of the cable holders;

fastening a second cable on an other one of the cable holders;

guiding the first and second cables on a guide device which, in a longitudinal direction of the pipe, is arranged between the cable holders and the upper end or above the upper end of the pipe, the guide device being part of a support device, wherein the guide device includes two rollers spaced from one another so that the pipe is guidable between the rollers, and wherein the first cable is guided on one of the rollers and the second cable is guided on an other one of the rollers, the two rollers being arranged above a center of gravity of the vibrator arrangement prior to the pipe being lowered into the ground such that the two rollers solely support the pipe prior to being lowered into the ground;

raising the vibrator arrangement using the first and second cables, wherein the vibration arrangement is lowered solely as a result of inherent weight thereof without any additional external force acting thereon; and the cable holders and the pipe penetrating into the ground.

19. The method as claimed in claim 18, wherein the support device further includes at least two guide members which are arranged spaced from one another in a longitudinal direction of the pipe and which are designed to guide the pipe.

20. The method as claimed in claim 18, wherein a vibrator arrangement is arranged on the lower end of the pipe.

21. The method as claimed in claim 18, wherein the guide device is arranged between the cable holders and the upper end while the first cable is fastened to the one of the cable holders and while the second cable is fastened to one of the other one of the cable holders, wherein the cable holders are configured, together with the pipe, to penetrate into the ground while the first cable is fastened to the one of the cable holders and while the second cable is fastened to one of the other one of the cable holders, and wherein the first and second cables are the only cables used to raise the vibrator arrangement.

* * * * *